US005785537A

United States Patent [19]

Donahue et al.

[11] Patent Number: 5,785,537

[45] Date of Patent: Jul. 28, 1998

[54] ELECTRICAL CONNECTOR INTERLOCKING APPARATUS

[75] Inventors: F. Todd Donahue, Jeffersonville, Ind.; Jose L. Ortega, Louisville, Ky.

[73] Assignee: Robinson Nugent, Inc., New Albany, Ind.

[21] Appl. No.: 670,643

[22] Filed: Jun. 26, 1996

[51] Int. Cl.[6] ..... H01R 9/09

[52] U.S. Cl. ..... 439/79; 439/701

[58] Field of Search ..... 439/79, 80, 701, 439/680, 681, 686

[56] References Cited

U.S. PATENT DOCUMENTS

| | | | |
|---|---|---|---|
| 4,857,017 | 8/1989 | Erk | 439/701 |
| 4,952,172 | 8/1990 | Barkus et al. | 439/79 |
| 5,198,279 | 3/1993 | Beinhaur et al. | 439/79 |
| 5,252,080 | 10/1993 | Pesson | 439/79 |
| 5,584,728 | 12/1996 | Cheng | 439/637 |

OTHER PUBLICATIONS 3.6 Accessories, 48 B (Secretariat) 296, two pages.

Tempus CBC 20 Coding System, ITT Cannon brochure, p. 65, date unknown.

3.6 Accessories, SP-3179, one page, Sep. 9, 1994.

Accessories Board-to-Board Coding System, Berg Electronics brochure, pp. 72 and 73, date unknown.

*Primary Examiner*—Hien Vu

*Attorney, Agent, or Firm*—Barnes & Thornburg

[57] ABSTRACT

An apparatus is provided for locking first and second adjacent electrical connector modules which are stacked end-to-end. The first and second modules each are formed to include an insulative housing, a plurality of windows in communication with a plurality of contacts coupled to the housing, and a foot section formed to include a coding slot. The contacts have contact terminals extending beyond a rear wall of the housing in a plurality of rows. The apparatus includes a cap having an insulative body including a plurality of spaced apart divider walls configured to define a plurality of slots, each slot being configured to receive a row of the contact terminals. The insulative body of the cap extends across abutting ends of the first and second connector modules. The apparatus also includes a locking clip configured to engage adjacent abutting foot sections of the first and second connector modules to lock the abutting foot sections together.

16 Claims, 4 Drawing Sheets

ELECTRICAL CONNECTOR INTERLOCKING APPARATUS

BACKGROUND AND SUMMARY OF THE INVENTION

The present invention relates to an electrical connector interlocking system. More particularly, the present invention provides an interlocking system for providing a customized connector, built from separate modular connector components, which functions like a one-piece connector.

Electronics industry requirements for electrical connector length, number of contact rows (density), and power contact configurations for backplane connectors continue to increase. Most backplane connector customer requirements are application specific in terms of the I/O number and the board layout configurations. In an effort to address the multitude of "custom" customer requirements, modular connectors have been developed to permit end-to-end stacking of electrical connectors. By providing a building-block or modular connector approach, connector suppliers are able to address the multitude of custom industry application requirements while realizing economies of scale in the manufacturing process. Therefore, the modular approach is desirable from a manufacturing standpoint to reduce tooling and assembly costs associated with the manufacture of connectors having high density, very long, one-piece custom insulator bodies.

From a customer standpoint, however, a one-piece connector facilitates inventory and assembly requirements. The present invention provides a connector interlocking apparatus and method which permits the manufacturer to supply customers with a one-piece custom connector design, while allowing the manufacturer to achieve economies of scale through manufacture of smaller, standardized building block connector modules.

The present invention provides a system including an interlocking cap and an interlocking clip for coupling or interlocking discrete, modular, end-to-end stackable connector components into a customized one-piece connector. The present invention eliminates the need for incurring high tooling costs and manufacturing expenses typically associated with development of customized backplane connectors that require very long, one-piece plastic insulators.

The interlocked connector of the present invention is not limited to signal or power connectors. The customer can combine both signal and power within the same integrated connector. The "mono-locked" connector system of the present invention is not limited in length or number of configurations.

The present invention can also be used with existing code key to arrangements. In one embodiment of the present invention, the clip is integrated with a code key to perform the coding function and also the interlocking function of the clip. In yet another embodiment, the clip is formed between two adjacent code key sections to combine the clip and coding keys into a single component.

The interlocking apparatus and method of the present invention locks adjacent connector modules in an X-axis, a Y-axis, and a Z-axis. Therefore, the interlocking elements of the present invention rigidly contain the individual connector modules as a single locked unit. Therefore, the single unit can be handled, stored, and assembled by the customer in the same manner as a single-insulator, custom electrical connector.

According to one aspect of the present invention, an apparatus is provided for locking first and second adjacent electrical connector modules which are stacked end-to-end. The first and second modules each are formed to include an insulative housing, a plurality of windows in communication with a plurality of contacts coupled to the housing, and a foot section formed to include a coding slot. The contacts have contact terminals extending beyond a rear wall of the housing in a plurality of rows. The apparatus includes a cap having an insulative body including a plurality of spaced apart divider walls configured to define a plurality of slots, each slot being configured to receive a row of the contact terminals. The insulative body of the cap extends across abutting ends of the first and second connector modules. The apparatus also includes a locking clip configured to engage adjacent abutting foot sections of the first and second connector modules to lock the abutting foot sections together.

In the illustrated embodiment, the locking clip is formed to include first and second spring arms extending away from a web portion for engaging the abutting foot sections of the first and second connector modules, respectively. The web portion has a thickness substantially equal to a thickness of the coding slots. The first and second spring arms are each formed to include a barbed portion adjacent a distal end spaced a part from the web portion. Each barbed portion is formed to include a lead in ramp surface and a trailing surface which extends generally perpendicular to the first and second spring arms for engaging a rear surface of the foot sections of the first and second connector modules.

The cap is configured to lock the first and second modules together along a X-axis. The locking clip is configured to lock the first and second modules together along a Y-axis and a Z-axis.

According to one aspect of the present invention, an apparatus is provided for locking first and second adjacent electrical connector modules which are stacked end-to-end. The first and second modules each are formed to include an insulative housing, a plurality of windows in communication with a plurality of contacts coupled to the housing, and a foot section formed to include a coding slot. The contacts have contact terminals extending beyond a rear wall of the housing in a plurality of rows. The apparatus includes a cap having an insulative body configured to engage the contact terminals to hold the first and second connector modules together, a code key having a body portion formed to include a coded section, and a locking clip integrally formed with the code key. The locking clip is configured to engage abutting foot sections of the first and second connector modules to lock the abutting foot sections together.

In the illustrated embodiment, the insulative body of the cap extends across abutting ends of the first and second connector modules and has a plurality of spaced apart divider walls configured to define a plurality of slots. Each slot is configured to receive a row of the contact terminals.

The locking clip is formed to include a spring arm extending away from a web portion for engaging the abutting a foot section of the first connector module. The web portion has a thickness substantially equal to a thickness of the coding slots. The spring arm is formed to include a barbed portion adjacent a distal end spaced a part from the web portion. The barbed portion is formed to include a lead in ramp surface and a trailing surface which extends generally perpendicular to the spring arm for engaging a rear surface of the foot section of the first connector module.

In another illustrated embodiment, the apparatus includes a second code key having a body portion formed to include a coded section. The first and second code keys are interconnected by a web portion configured to define the locking clip between the first and second code keys for locking the abutting foot sections of the first and second connector modules.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
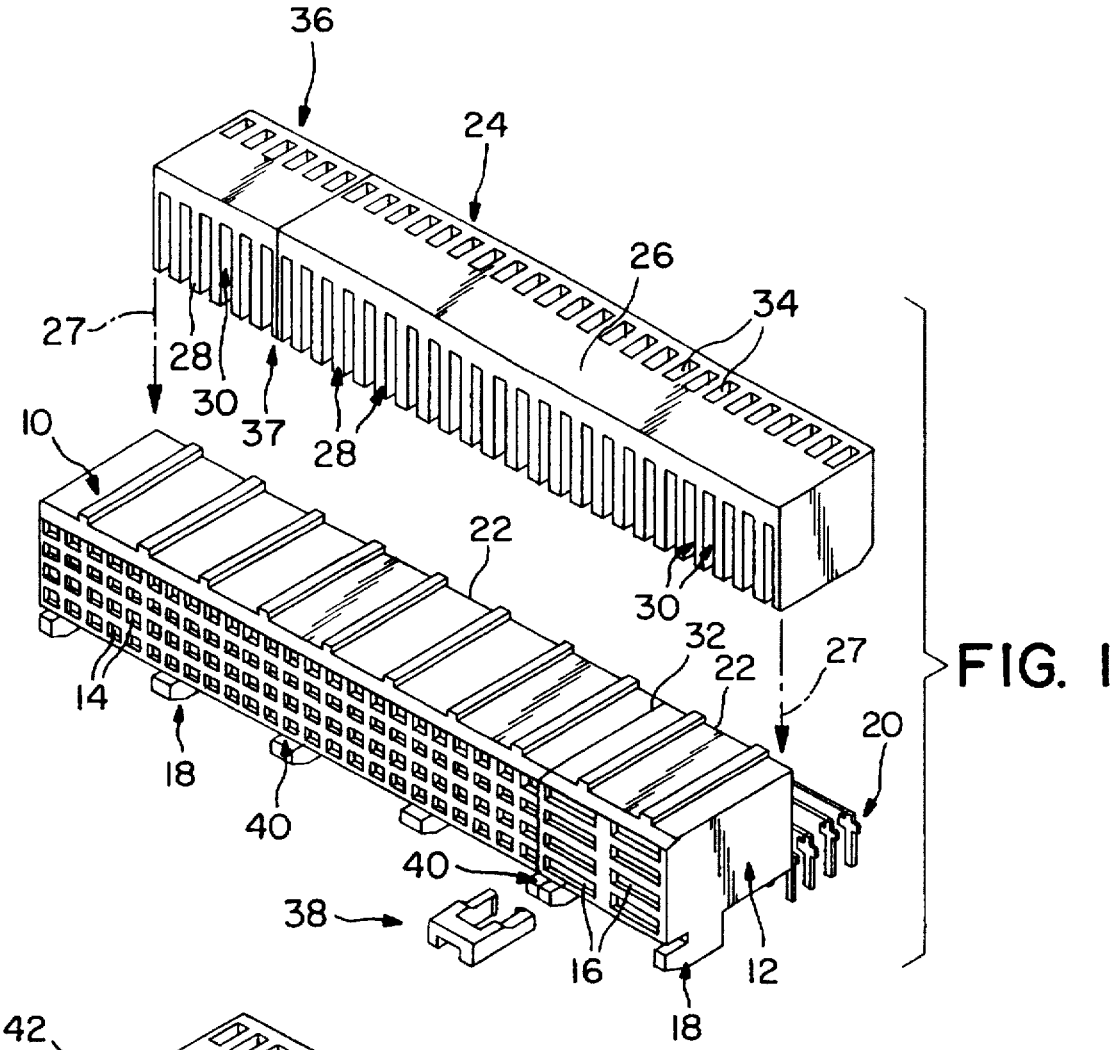
FIG. 1 is an exploded perspective view of the electrical connector interlocking apparatus of the present invention including a cap for insertion over contact terminals of the connector and a locking clip for coupling feet of adjacent connector modules together to form an interlocked connector which simulates a one-piece, custom connector.

Referring now to the drawings, FIGS. 1–5 illustrate a first embodiment of the electrical connector interlocking apparatus of the present invention. As discussed above, the electronics industry backplane connector requirements continue to expand in terms of connector length, number of contact rows (density), and power contact configurations. Custom requirements for backplane connectors are application specific in terms of I/O number and board layout configurations. In an effort to address this multitude of custom connector requirements, connector manufacturers have developed connectors that permit end-to-end modular stacking of adjacent connectors. Examples of these modular, stacking connectors include METPAK2™ connectors available from Robinson Nugent, Inc., as well as Futurebus+ EIA/SP-3179 connectors, the Teradyne HDM+ connectors, and the AMP Z-Pak HM connectors.

These modular connectors permit the connector suppliers to address the many custom industry application requirements while still realizing economies as scale in the manufacturing processes. Tooling and assembly costs associated with the manufacture of high density, very long, one-piece custom insulator body backplane connectors are very high. The modular connectors permit several shorter connectors to be stacked end-to-end to form the larger connector.

Customers, however, still prefer a "one-piece" connector to facilitate inventory and assembly. The interlocking apparatus and method of the present invention permits modular connectors to be interlocked in a desired configuration and shipped to the customers as a single piece unit. However, since the connector of the present invention is still made up of modular parts, the connector manufacturer can achieve economies as scale through manufacturers of standardized building-block modules.

The apparatus and method of the present invention permits reliable interlocking of discrete modular, end-to-end stackable, connector components so that a customer can be supplied with a customized connector which functions as a one-piece connector. The interlocking system of the present invention eliminates the need for incurring high tooling costs and manufacturing expenses typically associated with production of customized backplane connectors that use very long, high density, one-piece plastic insulators.

Referring now to FIG. 1, the interlocking apparatus of the present invention is designed to connect a first electrical connector module 10 to an adjacent second connector module 12. The first connector module 10 includes a plurality of connector windows 14 for receiving pins of a header connector (not shown). Connector module 12 also includes a plurality of connector windows 16.

Connector modules 10 and 12 include insulative feet 18 which are formed integrally with the connector bodies. The feet 18 adjacent opposite ends of the modules 10 and 12 have a thickness which is about half the thickness of the remaining feet 18. Electrical contacts are located within connector modules 10 and 12 in a conventional manner for receiving the male pins of the header connector which extend through windows 14 and 16. Contact terminals 20 extend from a rear wall 22 of connector modules 10 and 12. The terminals 20 are configured to be connected to conductive pads or to conductive through holes on a printed circuit board to provide an electrical connection between the contact terminals 20 and the printed circuit board.

Figure 2:
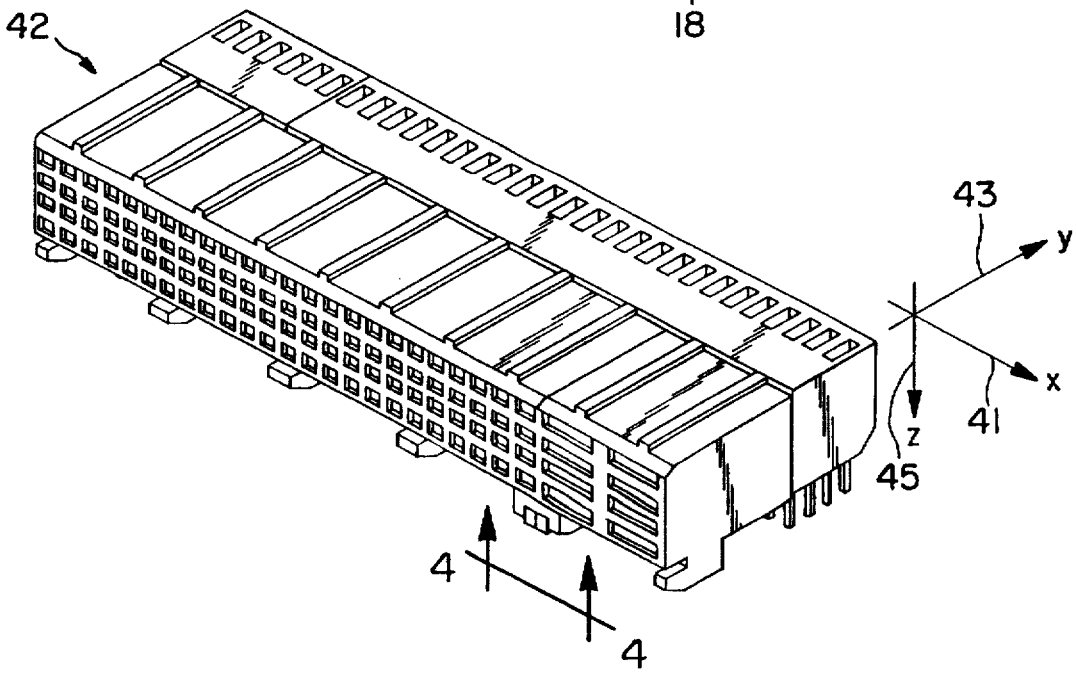
FIG. 2 is a perspective view of the assembled connector modules, caps, and clip of FIG. 1.

The interlocking apparatus of the present invention includes a interlocking cap 24 having an insulative housing 26 which is formed to include a plurality of downwardly extending divider walls 28. The divider walls 28 are spaced apart to define slots 30. The cap 24 is configured to be installed downwardly in the direction of arrows 27 over the outwardly extending contact terminals 20 until the cap is seated as illustrated in FIG. 2. Contact terminals are aligned in a plurality of rows. Each row of contact terminals 20 is configured to enter a separate slot 30 formed between divider walls 28 of cap 24. As illustrated in FIGS. 1 and 2, cap 24 is configured to span across an interconnection joint 32 between adjacent connector modules 10 and 12 to retain the modules 10 and 12 together. Openings 34 are formed in a top surface of housing 26.

In the embodiment illustrated in FIGS. 1 and 2, a second cap 36 having a length equal to the length of module 12 is located at an end of module 10. The end walls 37 of adjacent caps 24 and 36 have a thickness which is one-half the thickness of the divider walls 28. Therefore, the caps 24 and 36 are end-to-end stackable. In another embodiment, the cap can have a length equal to the entire length of both module 10 and module 12.

The present invention also includes a locking clip 38 configured to be inserted into a coding slot 40 between adjacent feet 18 of connector modules 10 and 12. The coding slots 40 are known for receiving various coding systems which are known in the art. Details of locking clip 38 are discussed below with reference to FIGS. 3–5.

Once the caps 24 and 36 and the clip 38 are in position on the modules 10 and 12, the modules 10 and 12 function as a single interlocked or one-piece connector. Therefore, a customer can store the interlocked connector 42 illustrated in FIG. 2 as a unit to facilitate the assembly process and to facilitate inventory.

Figure 3:
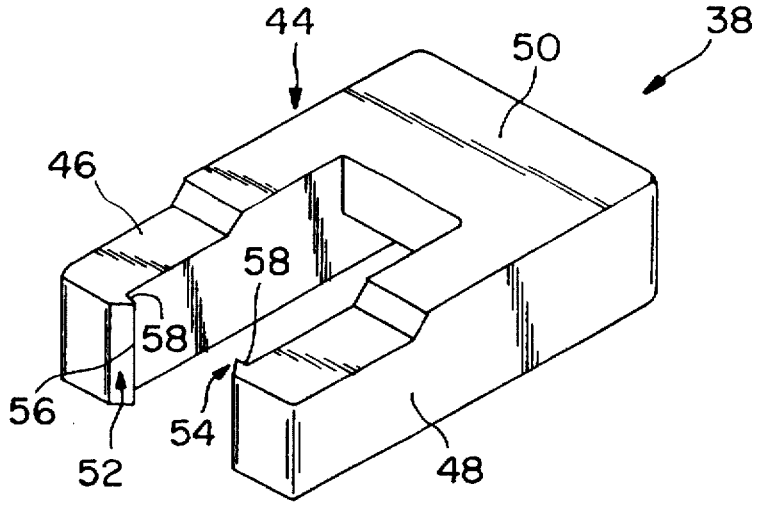
FIG. 3 is an enlarged perspective view of the locking clip of the present invention.
Figure 4:
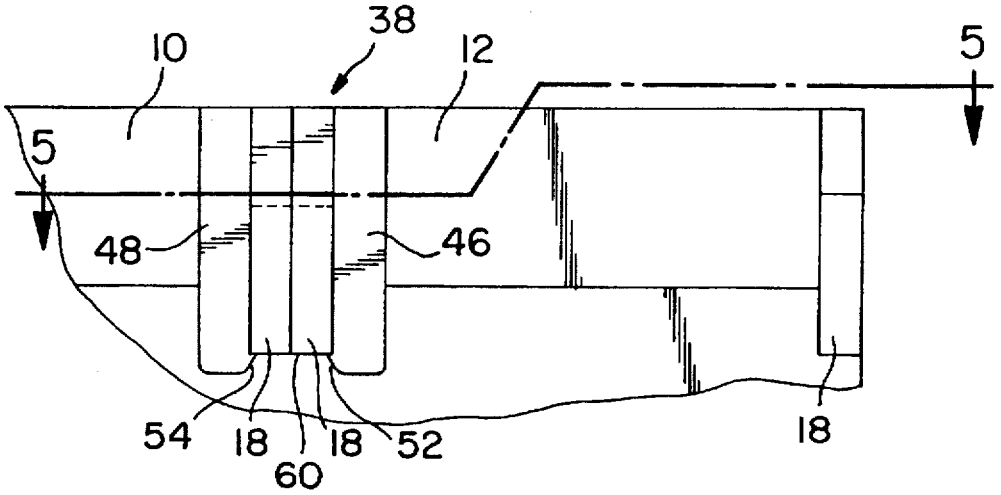
FIG. 4 is a partial bottom view taken along lines 4—4 of FIG. 2 illustrating engagement of the clip with the feet on adjacent connector modules.
Figure 5:
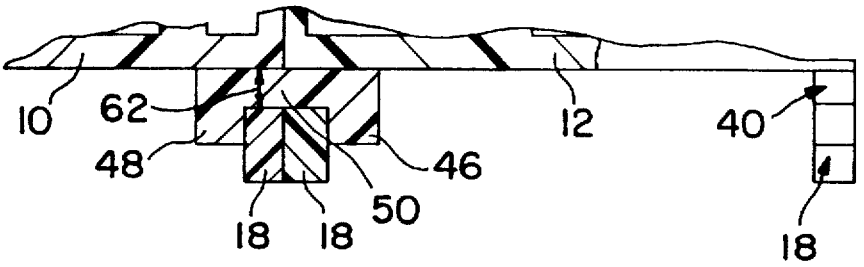
FIG. 5 is a sectional view taken along lines 5—5 of FIG. 4 further illustrating the locking clip and feet of the adjacent connector modules.

The clip 38 of the present invention is best illustrated in FIGS. 3–5. As illustrated in FIG. 3, clip 38 includes an insulative body 44 having first and second spring arms 46 and 48 extending outwardly from a web portion 50. Spring arms 46 and 48 include inwardly projecting barbs 52 and 54, respectively, adjacent distal ends spaced apart from the web portion 50. Barbs 52 and 54 each include a leading ramp surface 56 and a trailing flat surface 58 which extends generally perpendicular to spring beams 46 and 48.

The U-shaped locking clip 38 is inserted over feet 18 of adjacent modules 10 and 12. In the illustrated embodiment, spring beam 46 of clip 38 is adjacent foot 18 of connector module 12, and spring arm 48 of clip 38 is adjacent foot 18 of connector module 10. The ramp sections 56 of barbs 52 and 54 facilitate insertion of the clip 38 over the feet. If the barbs 52 and 54 engage a portion of the feet 18, the ramp surfaces 56 help the spring arms 46 and 48 expand outwardly to permit insertion of the clip 38 over the feet 18. Once the clip 38 is fully inserted as illustrated in FIG. 4, the trailing surfaces 58 of spring arms 46 and 48 engage a rear edge 60 of feet 18 to hold the clip 38 in place between the adjacent modules 10 and 12.

As best illustrated in FIG. 5, the web section 50 has a thickness illustrated by dimension 62 which is substantially equal to a thickness of the code key slots 40. As illustrated in FIGS. 1 and 2, the interlocked connector modules 10 and 12 are not limited to signal or power connectors. The customer can combine both signal and power modules within the same integrated connector. In addition, the interlocked connectors are not limited to only two modules. Any number of modules can be interconnected using the cap 24 and clip 38 of the present invention as illustrated in FIG. 6.

The divider walls 28 and slots 30 which receive contact terminals 20 of modules 10 and 12 are configured to lock the contact terminals 12 of the adjacent modules 10 and 12 together. Therefore, the caps 24 and 36 hold the modules rigid along the X-axis 41 illustrated in FIG. 2. The locking clip 38 holds the adjacent modules 10 and 12 together in the Y-axis 43 of FIG. 2 due to the engagement of spring arms 46 and 48 along with the engagement of trailing surfaces 58 with the surfaces 60 of the feet 18 of adjacent modules 10 and 12. In addition, since the thickness 62 of web section 50 is substantially equal to the thickness of the adjacent coding slots 40, clip 38 also locks the adjacent modules 10 and 12 along the Z-axis 45 of FIG. 2. Since the connector illustrated in FIG. 2 is locked in all three directions, a customer can inventory and assemble mono-locked connector of FIG. 2 in an identical manner as the customer would normally order a single-insulator, one-piece customer connector. The caps 24 and 36 also align the contact terminals 20 along a common centerline in the X-axis 41 and the Y-axis 43.

Figure 6:
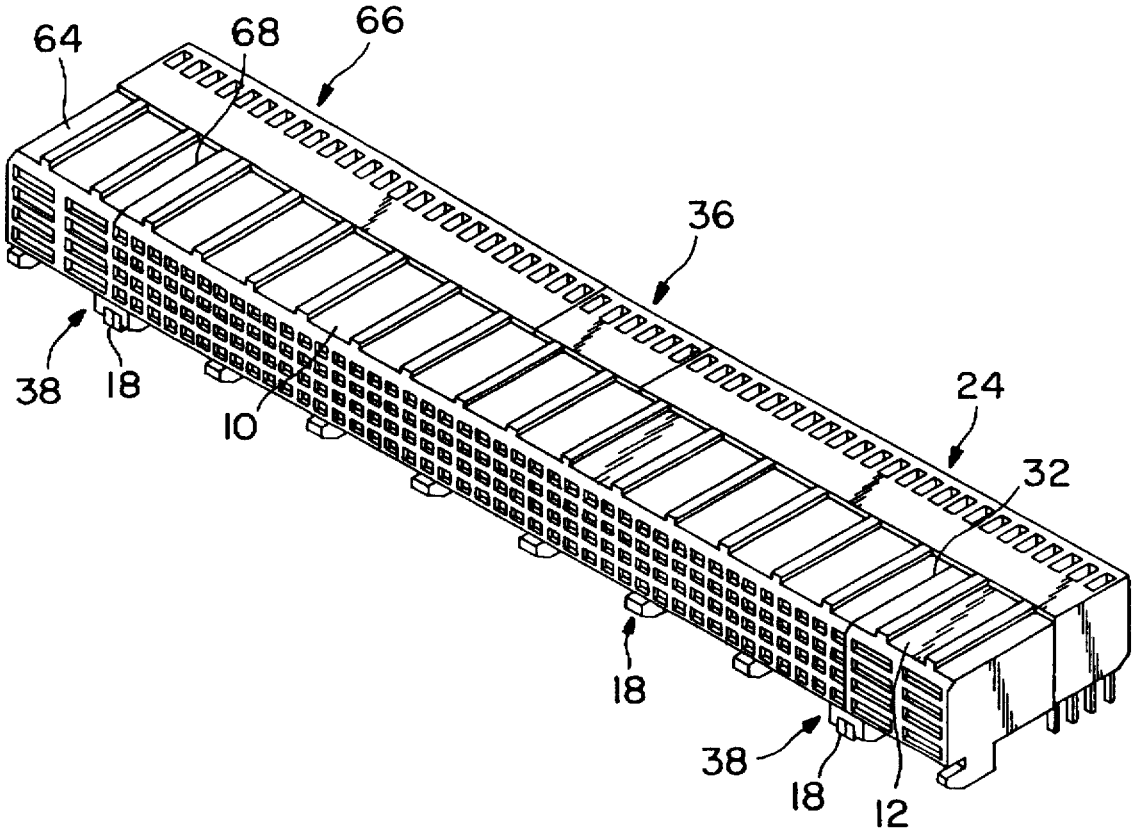
FIG. 6 is a perspective view of another embodiment of the present invention in which three separate connector modules are interconnected using the caps and clips of the present invention.

FIG. 6 illustrates another embodiment of the present invention in which more than two modules are interconnected. Specifically, another module 64 has been added to the opposite end of connector module 10 to provide an even longer locked connector. In this embodiment, a cap 66 overlaps abutting ends 68 of module 10 and module 64. Another clip 38 is used to lock the feet 18 of the abutting ends 68 of modules 10 and 64.

Figure 7:
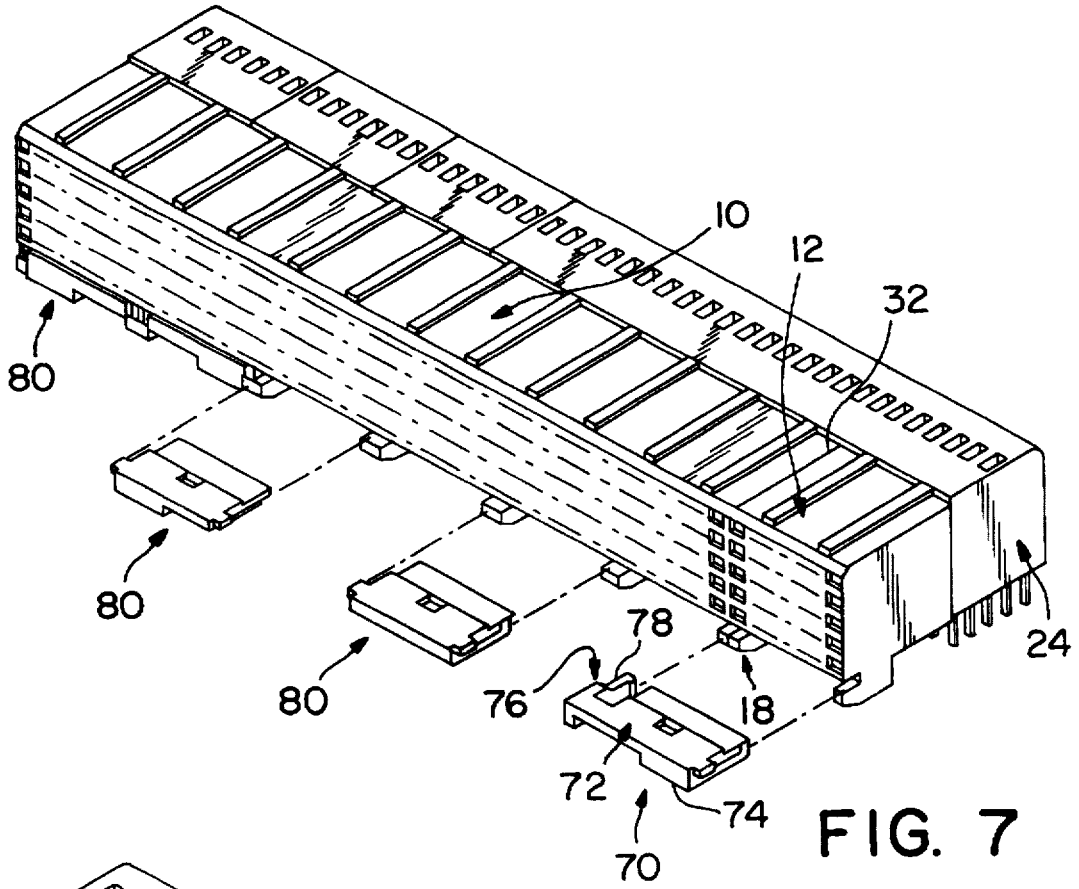
FIG. 7 is a perspective view of another embodiment of the present invention in which the clip of the present invention has been integrated with a code key.

Yet another embodiment of the present invention is illustrated in FIG. 7. In this embodiment, the clip 38 has been integrated with a conventional code key to form an improved code key 70. Code key 70 includes a body 72 which has a standard coding section 74 configured to mate with a complementary coding section located on the header connector (not shown). In the improved code key 70 of the present invention also includes a clip 76. Clip 76 functions in a manner similar to clip 38 of FIGS. 1–6. Clip 76 includes a spring arm 78 having a barbed end similar to barb 54. When the improved code key 70 is installed on the module 12, the clip 76 interlocks the adjacent feet 18 of modules 10 and 12 in a manner discussed above. Other convention code keys 80 can be used with the interlocked connector illustrated in FIG. 7. The interlocking caps 24 and 36 are also used to interlock the modules 10 and 12 in FIG. 7 as discussed above.

Figure 8:
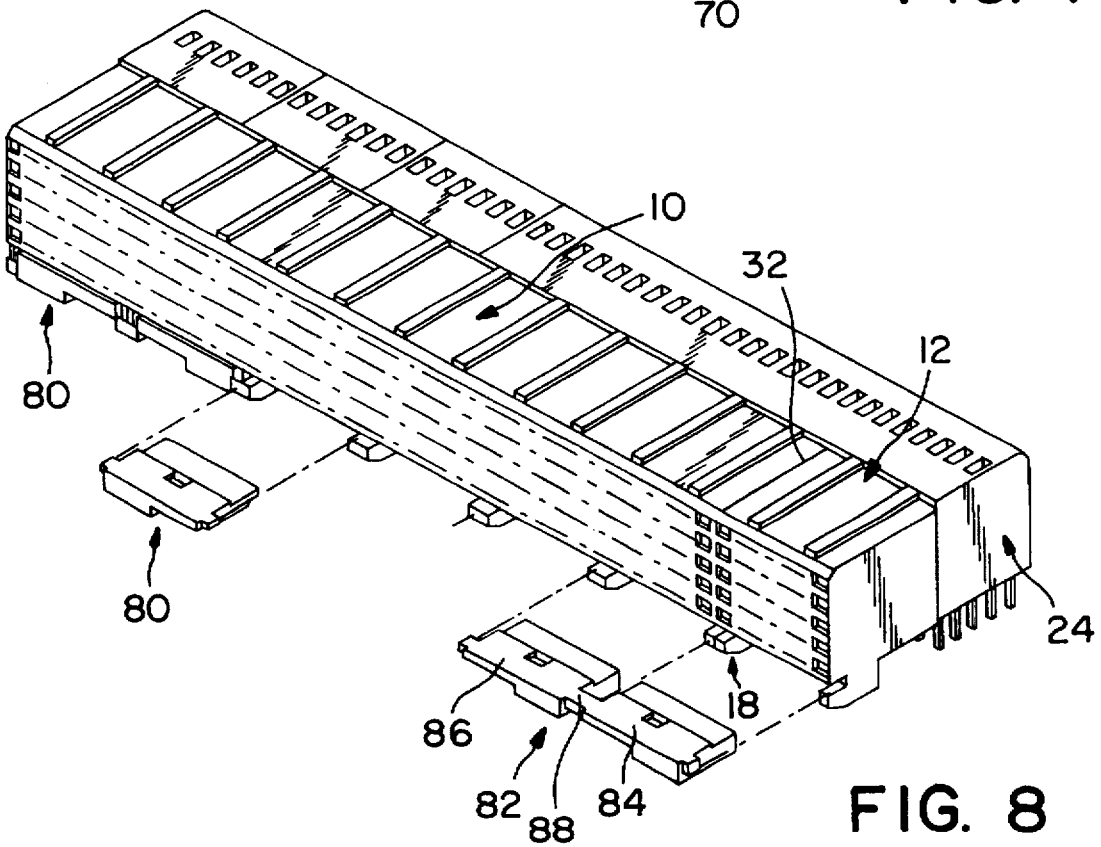
FIG. 8 is a perspective view of yet another embodiment of the present invention in which the clip of the present invention is formed between two interconnected code keys.

Still another embodiment of the present invention is illustrated in FIG. 8. In this embodiment, a dual code key apparatus 82 includes a first code key body 84 integrally formed with a second code key body 86. An interconnecting web portion 88 is formed between code key body 84 and code key body 86 to provide a clip for interlocking feet 18 of adjacent connector modules 10 and 12 as discussed above with reference to clip 38. The web portion 88 has substantially the same thickness as the coding slot 40 of feet 18 as discussed above.

The improved code keys 70 and 82 illustrated in FIGS. 7 and 8, respectively, permit the formation of an interlocked connector that functions as a one-piece connector. The interlocked connectors provide coding capabilities for customers that require coding keys between the backplane connectors 10 and 12 and the header connectors (not shown).

Although the invention has been described in detail with reference to a certain preferred embodiment, variations and modifications exist within the scope and spirit of the present invention as described and defined in the following claims.

What is claimed is:

1. An apparatus for locking first and second adjacent electrical connector modules which are stacked end-to-end, the first and second modules each being formed to include an insulative housing, a plurality of windows in communication with a plurality of contacts coupled to the housing, and a foot section formed to include a coding slot, the contacts having contact terminals extending beyond a rear wall of the housing in a plurality of rows, the apparatus comprising:

a cap having an insulative body including a plurality of spaced apart divider walls configured to define a plurality of slots, each slot being configured to receive a row of the contact terminals, the insulative body of the cap extending across abutting ends of the first and second connector modules to lock the first and second adjacent electrical connector modules together along an axis; and a locking clip configured to engage adjacent abutting foot sections of the first and second connector modules to lock the abutting foot sections together, the locking clip including first and second substantially parallel spring arms which are configured to extend away from a web portion and engage the abutting foot sections of the first and second connector modules, respectively, the first and second spring arms each being formed to include a barbed portion adjacent a distal end spaced a part from the web portion.

2. The apparatus of claim 1, wherein the web portion has a thickness substantially equal to a thickness of the coding slots.

3. The apparatus of claim 1, wherein the cap is configured to lock the first and second modules together along a X-axis.

4. The apparatus of claim 3, wherein the locking clip is configured to lock the first and second modules together along a Y-axis and a Z-axis.

5. An apparatus for locking first and second adjacent electrical connector modules which are stacked end-to-end, the first and second modules each being formed to include an insulative housing, a plurality of windows in communication with a plurality of contacts coupled to the housing, and a foot section formed to include a coding slot, the contacts having contact terminals extending beyond a rear wall of the housing in a plurality of rows, the apparatus comprising:

a cap having an insulative body including a plurality of spaced apart divider walls configured to define a plurality of slots, each slot being configured to receive a row of the contact terminals, the insulative body of the cap extending across abutting ends of the first and second connector modules; and a locking clip including first and second spring arms extending away from a web portion for engaging the abutting foot sections of the first and second connector modules, respectively, the first and second spring arms each being formed to include a barbed portion adjacent a distal end spaced a part from the web portion, each barbed portion being formed to include a lead in ramp surface and a trailing surface which extends generally perpendicular to the first and second spring arms for engaging a rear surface of the foot sections of the first and second connector modules.

6. An apparatus for locking first and second adjacent electrical connector modules which are stacked end-to-end, the first and second modules each being formed to include an insulative housing, a plurality of windows in communication with a plurality of contacts coupled to the housing, and a foot section formed to include a coding slot, the contacts having contact terminals extending beyond a rear wall of the housing in a plurality of rows, the apparatus comprising:

a cap having an insulative body including a plurality of spaced apart divider walls configured to define a plurality of slots, each slot being configured to receive a row of the contact terminals, the insulative body of the cap extending across abutting ends of the first and second connector modules, a locking clip configured to engage adjacent abutting foot sections of the first and second connector modules to lock the abutting foot sections together; and a code key having a body portion formed to include a coded section, the code key body being integrally formed with the locking clip for locking the abutting foot sections of the first and second connector modules.

7. An apparatus for locking first and second adjacent electrical connector modules which are stacked end-to-end, the first and second modules each being formed to include an insulative housing, a plurality of windows in communication with a plurality of contacts coupled to the housing, and a foot section formed to include a coding slot, the contacts having contact terminals extending beyond a rear wall of the housing in a plurality of rows, the apparatus comprising:

a cap having an insulative body including a plurality of spaced apart divider walls configured to define a plurality of slots, each slot being configured to receive a row of the contact terminals, the insulative body of the cap extending across abutting ends of the first and second connector modules;

a locking clip configured to engage adjacent abutting foot sections of the first and second connector modules to lock the abutting foot sections together; and first and second code keys, each code key having a body portion formed to include a coded section, the first and second code keys being interconnected by a web portion to define the locking clip between the first and second code keys for locking the abutting foot sections of the first and second connector modules.

8. An apparatus for locking first and second adjacent electrical connector modules which are stacked end-to-end, the first and second modules each being formed to include an insulative housing, a plurality of windows in communication with a plurality of contacts coupled to the housing, and a foot section formed to include a coding slot, the contacts having contact terminals extending beyond a rear wall of the housing in a plurality of rows, the apparatus comprising:

a cap having an insulative body configured to engage the contact terminals to hold the first and second connector modules together;

a code key having a body portion formed to include a coded section; and a locking clip integrally formed with the code key, the locking clip being configured to engage abutting foot sections of the first and second connector modules to lock the abutting foot sections together.

9. The apparatus of claim 8, wherein the insulative body of the cap extends across abutting ends of the first and second connector modules and has a plurality of spaced apart divider walls configured to define a plurality of slots, each slot being configured to receive a row of the contact terminals.

10. The apparatus of claim 8, wherein the locking clip is formed to include a spring arm extending away from a web portion for engaging the abutting a foot section of the first connector module.

11. The apparatus of claim 10, wherein the web portion has a thickness substantially equal to a thickness of the coding slots.

12. The apparatus of claim 10, wherein the spring arm is formed to include a barbed portion adjacent a distal end spaced a part from the web portion.

13. The apparatus of claim 12, wherein the barbed portion is formed to include a lead in ramp surface and a trailing surface which extends generally perpendicular to the spring arm for engaging a rear surface of the foot section of the first connector module.

14. The apparatus of claim 8, further comprising a second code key having a body portion formed to include a coded section, the first and second code keys being interconnected by a web portion configured to define the locking clip between the first and second code keys for locking the abutting foot sections of the first and second connector modules.

15. An apparatus for locking first and second adjacent electrical connector modules which are stacked end-to-end, the first and second modules each being formed to include an insulative housing, a plurality of windows in communication with a plurality of contacts coupled to the housing, and a foot section formed to include a coding slot, the contacts having contact terminals extending beyond a rear wall of the housing in a plurality of rows, the apparatus comprising:

a cap having an insulative body configured to engage the contact terminals, the cap being configured to extend across abutting ends of the first and second connector modules to lock the first and second connector modules together along a X-axis; and a locking clip configured to engage adjacent abutting foot sections of the first and second connector modules to lock the abutting foot sections together along a Y-axis and a Z-axis, the locking clip being formed to include first and second substantially parallel spring arms configured to extend away from a web portion and engage the abutting foot sections of the first and second connector modules, respectively, the web portion having a thickness substantially equal to a thickness of the coding slots, and the first and second spring arms each being formed to include a barbed portion adjacent a distal end spaced a part from the web portion.

16. The apparatus of claim 15, wherein each barbed portion is formed to include a lead in ramp surface and a trailing surface which extends generally perpendicular to the first and second spring arms for engaging a rear surface of the foot sections of the first and second connector modules.

* * * * *